US007407073B2

(12) United States Patent
Rafaeli

(10) Patent No.: US 7,407,073 B2
(45) Date of Patent: Aug. 5, 2008

(54) NAIL GUIDE

(75) Inventor: Gilad Rafaeli, Givat Haim Ichud (IL)

(73) Assignee: M.G.H Agricultural cooperative Society Ltd., Givat Haim Ichud (IL)

( * ) Notice: Subject to any disclaimer, the term of this patent is extended or adjusted under 35 U.S.C. 154(b) by 0 days.

(21) Appl. No.: 10/596,699

(22) PCT Filed: Jan. 27, 2005

(86) PCT No.: PCT/IL2005/000099

§ 371 (c)(1),
(2), (4) Date: Jun. 22, 2006

(87) PCT Pub. No.: WO2005/072063

PCT Pub. Date: Aug. 11, 2005

(65) Prior Publication Data

US 2007/0181630 A1 Aug. 9, 2007

Related U.S. Application Data

(60) Provisional application No. 60/539,347, filed on Jan. 28, 2004.

(51) Int. Cl.
*B25C 1/02* (2006.01)

(52) U.S. Cl. ..... 227/119; 227/18; 227/147; 227/156

(58) Field of Classification Search ..... 227/147, 227/119, 15, 18, 156, 140; 81/23, 27, 44
See application file for complete search history.

(56) References Cited

U.S. PATENT DOCUMENTS

| | | | | | |
|---|---|---|---|---|---|
| 952,571 | A | | 3/1910 | Lamb | |
| 2,199,833 | A | | 5/1940 | Fleischman | |
| 2,866,971 | A | * | 12/1958 | Kelleher | 342/11 |
| 2,896,209 | A | | 7/1959 | Hilti | |
| 3,060,440 | A | * | 10/1962 | De Caro et al. | 227/147 |
| 3,847,193 | A | * | 11/1974 | Brunstetter | 81/44 |
| 4,037,632 | A | * | 7/1977 | Arena | 81/44 |
| 4,179,058 | A | * | 12/1979 | Yost | 227/147 |
| 4,367,778 | A | * | 1/1983 | Bradbury | 81/23 |
| 4,881,676 | A | * | 11/1989 | St. Peter | 227/63 |
| 4,960,235 | A | * | 10/1990 | Gregory | 227/147 |
| 5,165,588 | A | * | 11/1992 | Rowland | 227/147 |
| 5,529,234 | A | | 6/1996 | Juneau | |
| 6,036,073 | A | * | 3/2000 | Newhouse | 227/147 |
| 6,345,755 | B1 | * | 2/2002 | Fields | 227/142 |

* cited by examiner

*Primary Examiner*—Scott A. Smith
(74) *Attorney, Agent, or Firm*—Mark M. Friedman

(57) ABSTRACT

A nail-guiding device comprising a sleeve having a linear passage therethrough, the linear passage having a first end at least partially covered by a flexible membrane with an opening, the membrane operative to engage and hold the nail, and a piston slideably engaged in the linear passage and operative to transfer the impact of the driver to the nail in a drive-in operation.

17 Claims, 3 Drawing Sheets

(a) (b)

NAIL GUIDE

FIELD OF THE INVENTION

The present invention relates to handheld tools for driving nails, and more particularly to a cost effective nail guide tool with a simple and elegant integral nail holding element that holds and guides a nail as it is being driven into a substrate.

BACKGROUND OF THE INVENTION

Hammering a nail into wood, plaster, concrete, drywall or plastic, herein a substrate, requires that the nail be positioned properly both with respect to the substrate and with respect to the hammer, herein a driver. Nail guiding and driving tools (hereinafter "nail guides") that position a nail with respect to a substrate are known. Among those suggested through the years are the tools disclosed in U.S. patent applications Ser. No. 952,571 to Lamb, U.S. Pat. No. 2,199,833 to Fleischman and U.S. Pat. No. 2,896,209 to Hilti. The Hilti patent in particular discloses a driving tool for driving studs, nails or fasteners (hereinafter referred to all as "nails"), comprising a tubular member adapted to be gripped in the hand, within which is guided a ram (or piston) actuated along a straight line by mechanical blows, e.g. from a hammer. The tool includes a flange arranged to rest against the material into which the nail is to be driven, and which prevents the tool from tilting. The exact alignment of the nail in the direction of penetration is assured by two guiding elements (rockable arms 62) between which the nail extends during the driving operation, and which are as remote from each other at the beginning of the driving operation as possible. As in the present invention, the tool in U.S. Pat. No. 2,896,209 accepts nails with heads.

Commercial nail-guiding and driving tools are also known, the most relevant to the present invention being a tool that we will call the "Hilti tool". In contrast with the device disclosed in U.S. Pat. No. 2,896,209, the Hilti tool lacks the mentioned two guiding elements, and works only with headless nails. The holding and exact alignment of the nail in the direction of penetration is assured by a longitudinal (parallel to the driving axis) concentric hole drilled into the end of the piston. The headless nail is inserted into the hole, and driven into a substrate by blows imparted to the other end of the piston.

A main disadvantage of the tool in U.S. Pat. No. 2,896,209 is the rather complicated mechanism, which includes non-fixed guiding elements. On the other hand, a main disadvantage of the commercial Hilti tool is the fact that it works only with headless nails of a given diameter. Other nail guides, disclosed for example in U.S. Pat. Nos. 952,571 and 2,199,833 require other additional means to hold the nail as it is being driven-in. Yet other patents, such as U.S. Pat. No. 5,529,234, use magnetized materials to hold the nail, therefore being both complicated and working only on magnetic nails.

There is thus a widely recognized need for, and it would be highly advantageous to have, a simple and inexpensive handheld nail guide tool that assists in the proper holding, positioning and guiding of a regular nail (with a head) without resorting to movable guiding elements, magnetic means, or any other disadvantageous feature existing in prior art guide tools.

SUMMARY OF THE INVENTION

In an aspect of an embodiment of the present invention, a nail guide includes a sleeve having a linear passage therethrough, the linear passage having a first end at least partially covered by a flexible membrane operative to engage and hold a regular nail, and a piston slideably engaged in the linear passage. The flexible membrane has an opening aligned with a longitudinal driving axis of the piston. The opening is of a size that enables insertion of a nail head and that provides a securing hold on the nail shaft, before and while the nail is being driven into the substrate. The membrane is flexible enough to allow both insertion of a nail to engage the piston, and removal of the tool from the nail after the driving operation is completed.

According to the present invention there is provided a nail-guiding device that assists in the proper guiding of a nail with respect to a substrate and with respect to a driver comprising a sleeve having a linear passage therethrough, the linear passage having a first end at least partially covered by a flexible membrane operative to engage and hold the nail. The nail-guiding device further comprises a piston slideably engaged in the linear passage and operative to transfer the impact of the driver to the nail in a drive-in operation, whereby the membrane holds and guides the nail throughout the drive in operation.

According to one feature in the nail-guiding device of the present invention, the flexible membrane includes an opening that facilitates said engagement and holding of said nail.

According to another feature in the nail-guiding device of the present invention, the piston includes a first end operatively associated with the linear passage first end, the piston first end including a concave surface suitable for centering a head or a headless nail.

According to additional features in the nail-guiding device of the present invention, the membrane is fixedly attached to the sleeve by gluing or injection molding, is made preferably of a rubber such as TPR, and the opening is round, of a size roughly matching that of a nail shaft.

According to the present invention there is provided a hand tool for assisting the driving of a nail into a substrate at a drive-in location, comprising a guiding mechanism having a flexible membrane guiding element; and a driving element slideably engaged in the guiding mechanism and operative to drive the nail into the substrate at the drive-in location.

According to one feature in the hand tool of the present invention, the flexible membrane is fixedly attached to the guiding mechanism and includes a substantially centered opening for engaging and holding the nail before and through the drive-in.

According to the present invention there is provided a method for driving a nail into a substrate comprising the steps of providing a sleeve having a linear passage therethrough, the linear passage having a first end at least partially covered by a flexible membrane operative to engage and hold the nail, providing a piston with a first and a second end, the piston slideably engaged in the linear passage and operative to transfer the impact of a driver to the nail in the drive-in operation, inserting the nail head first into the flexible membrane to engage the piston at the first piston end; and holding the sleeve and driving the nail into the substrate by impacting the piston at the second piston end.

BRIEF DESCRIPTION OF THE DRAWINGS

Exemplary non-limiting embodiments of the invention are described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. The attached figures are.

DETAILED DESCRIPTION OF THE PREFERRED EMBODIMENTS

Figure 1:
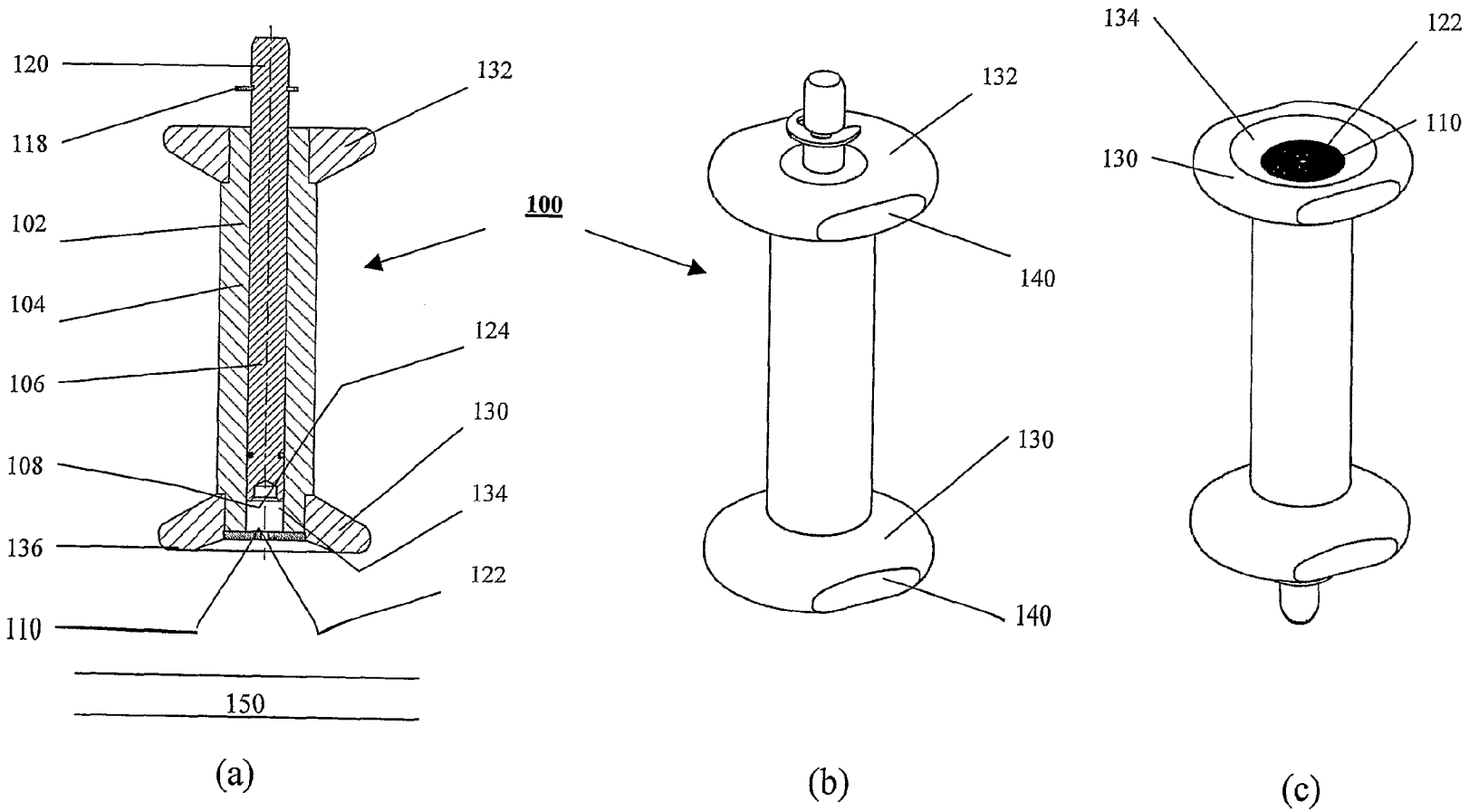
FIG. 1*a* shows a schematic cross sectional view of a nail guide, in accordance with an embodiment of the present invention.
FIG. 1*b* shows an external view of the nail guide of FIG. 1*a;*
FIG. 1*c* shows an isomeric external view of the nail guide of FIGS. 1*a* and 1*b*, emphasizing the membrane side.
Figure 2:
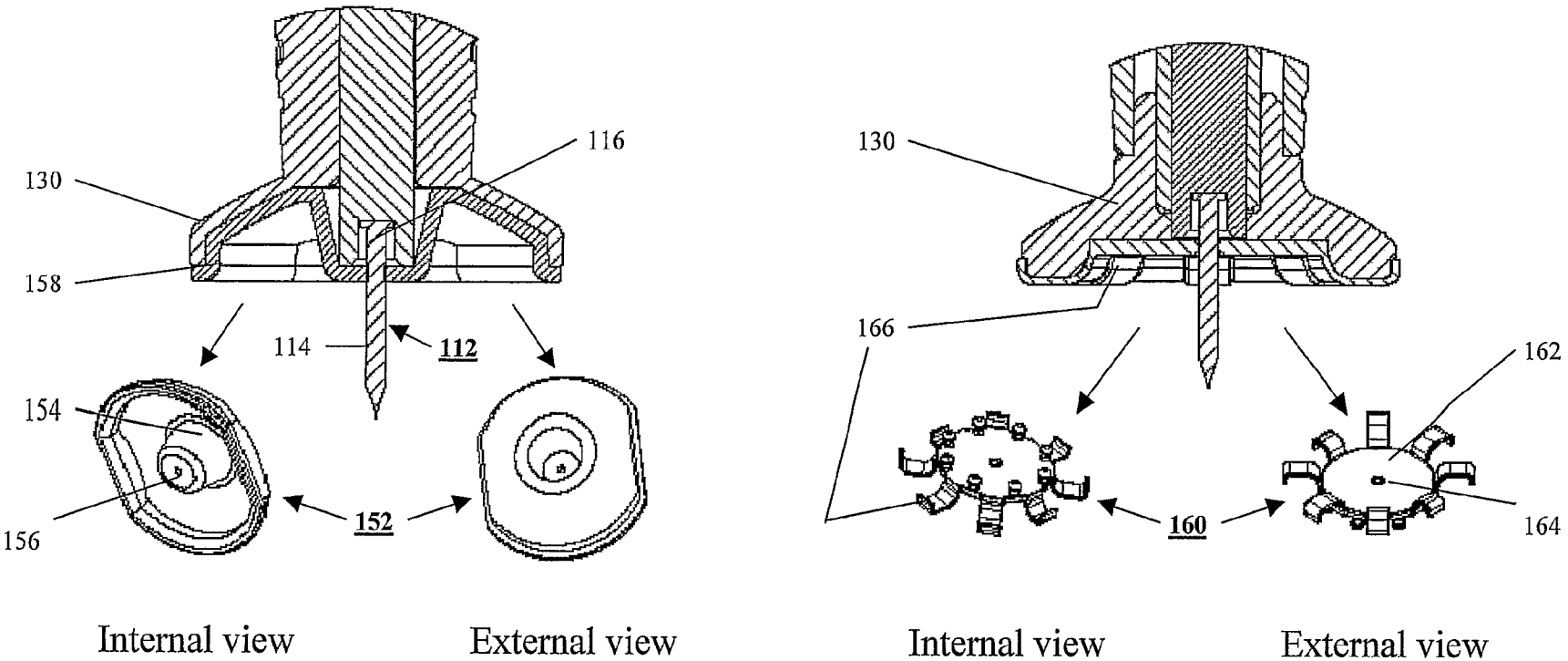
FIG. 2 shows in (a) and (b) cross sections of two other embodiments of the nail guide with injection-molded membranes.

FIG. 1 shows in (a-c) schematic views of a nail guide 100 in accordance with a preferred embodiment of the present invention. Nail guide 100 comprises a sleeve 102 having therethrough a linear passage 104 with a longitudinal axis 106, the linear passage having a first end 108 at least partially covered by a flexible membrane 110. Inventively, and in contrast with prior art, membrane 110 is operative to engage, hold and guide a regular (with head) or headless nail (see FIG. 2, which shows a nail 112 with a head 114 and a shaft 116. Nail guide 100 further comprises a piston 120 slideably engaged in the linear passage and operative to slide along axis 106. Piston 120 has a concave surface 124 suitable for engaging a nail head, or a nail shaft in the case of a headless nail. Concave surface 124 may be shaped to engage a variety of diameters of nail heads or nail shafts. In the present invention, "concave surface" implies any non-flat surface, e.g. a curved surface with a non-infinite radius, a cylindrical bore, a cone, a pyramid with a rectangular or hexagonal base, etc. The piston is prevented from penetrating into a depth larger than a predetermined value into the linear passage by a safety mechanism 118.

In order to engage and hold a nail, flexible membrane 110 has a center opening 122 aligned with longitudinal axis 106, and therefore piston 120. Membrane 110 and opening 122 are best seen in the isomeric view of FIG. 1*c*. Opening 122 is of a size that enables insertion of a nail head or shaft (for headless nails), usually using a limited force. The opening provides a securing hold on the nail shaft before and while the nail is being driven into a substrate 150. In other words, the opening has preferably a radius slightly smaller than the shaft of a nail intended for use, so that it provides a moderately tight hold for the shaft, but still allows insertion of a nail head (when present) that is larger than the shaft. Preferably, the opening is substantially round. The material is flexible enough to help opening 122 to expand and allow a nail head to pass through and engage concave surface 124. The material of the membrane is preferably a rubber such as a thermoplastic rubber (TPR) but may alternatively be another rubber, polymer, flexible plastic, etc. The membrane is also flexible enough to allow removal of the tool from the nail after the driving operation is completed, simple by pulling the sleeve away from the substrate. Optionally, the membrane may have at least one slit (not shown) intersecting the opening and aiding in the nail insertion and removal. This is referred to herein as a "slit opening." Exemplarily, the membrane thickness may vary between 0.1 and 5 mm, preferably between 1 and 3 mm, and most preferably around 2 mm.

We emphasize that the main inventive aspect of the nail guide of the present invention vs. all similar prior art tools lies in membrane 110 as the nail holding and guiding element. Unlike the Hilti tools, which require either mechanical guiding elements added to the sleeve (as in U.S. Pat. No. 2,896,209) or can use only headless nails, our tool has only the membrane, fixedly attached to the sleeve, as the element that fulfills the holding function, and which guides the nail in cooperation with concave surface 124 of the piston. This also contrasts with magnetic tools, in which a nail is basically held only by the piston.

Sleeve 102 has a first end 130 and a second end 132, which, in the embodiment shown, are substantially solid. The end sections may each have a flat 140 for stabilizing the tool when it lies on a surface. Flat 140 may also be used as a support surface for tilting the tool to allow nail insertion into the substrate at an angle different than 90 degrees. Membrane 110 may be fixedly attached to first end section 130 by any attachment means such as glue or injection molding. In the embodiment shown in FIG. 1*a*, end section 130 has a recess 134 for positioning membrane 110 so that it does not protrude from the sleeve beyond a substantially flat surface 136. Recess 134 may extend deeper into end section 130 than a predetermined thickness of the membrane. In the embodiment of FIG. 1, the membrane is glued to the recess, and covers partially first end 108. As in other nail guides, e.g. the Hilti tool, surface 136 is substantially perpendicular to axis 106, allowing positioning of the nail guide on substrate 150 so that the nail is driven perpendicularly into the substrate. The driving action is similar to that of other nail guides, and can be understood by reading for example the description in U.S. Pat. No. 2,896,209.

Examples of nail guides with injection-molded membranes are shown in alternative embodiments in FIGS. 2*a* and 2*b*. Each of the embodiments (2*a* and 2*b*) also has separate views of the membrane. The particular membrane shape shown is exemplary. Thus, a membrane 152 in (a) is shown having a center round and sunken section 154 with an opening 156, with an external perimeter 158 adapted to the perimeter of end section 130. A membrane 160 in (b) is shown having a central round section 162 with an opening 164, and eight anchoring side lobes 166 that wrap around end section 130. It will be apparent to anyone skilled in the art that the membrane may have a differently shaped central section, differently shaped side lobes, and a different number of lobes, and still fulfill its key role.

Figure 3:
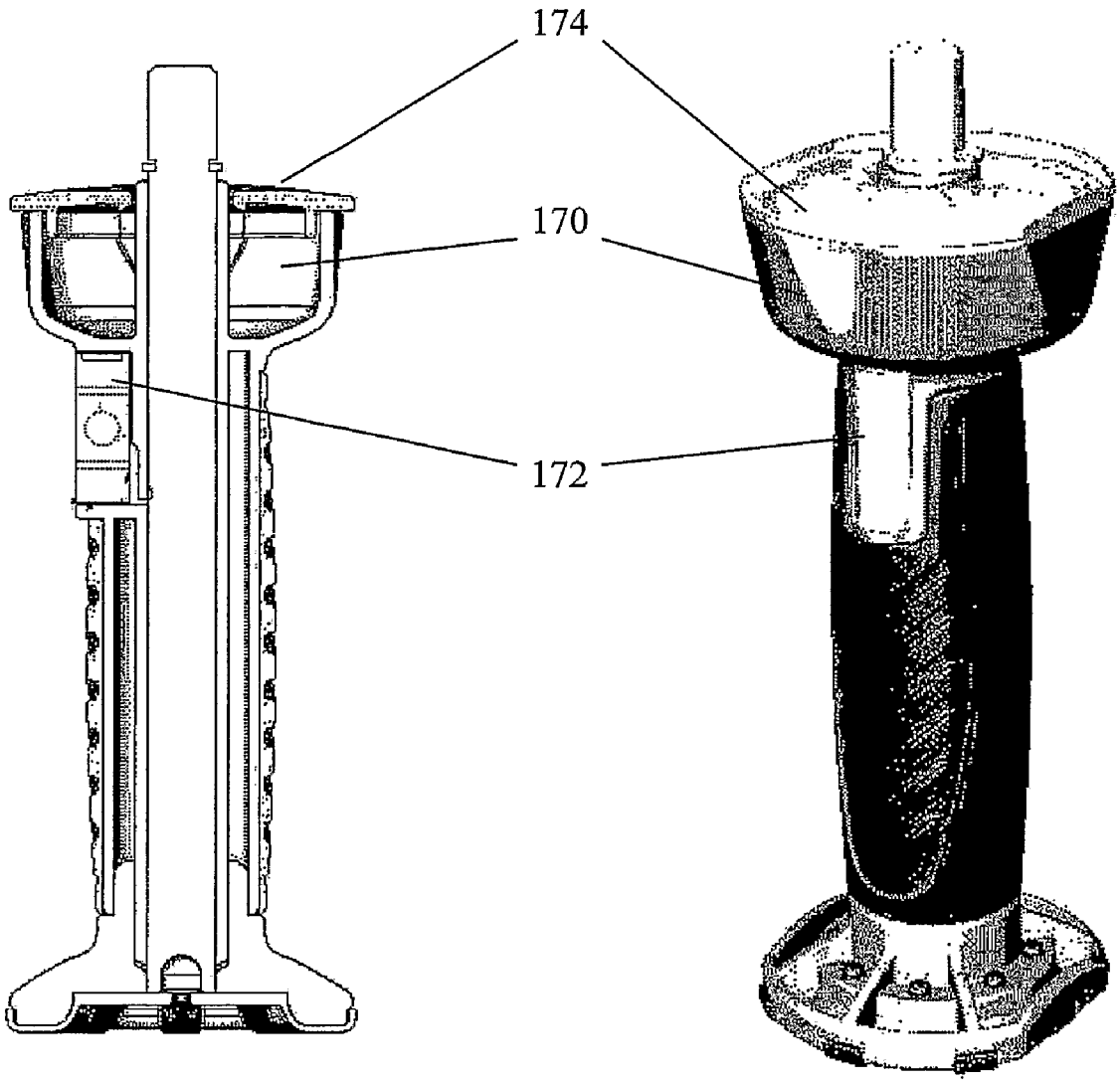
FIG. 3 shows in (a) a schematic cross sectional view and in (b) an external view of a nail guide with an optional accessory storage compartment and an optional level indicator.

FIG. 3 shows in (a) a schematic cross sectional view and in (b) an external view of a nail guide with an optional accessory storage compartment 170 and an optional level indicator 172. Compartment 170 is formed in end section 132 and may be used to store nails as well as other accessories, e.g. picture hangers. It may have a transparent cover 174 that allows the storage contents to be seen from the outside. The cover is removable, providing access to the stored accessories or nails. The level indicator may be used as a regular indicator tool, for example in a horizontal positioning of a picture nailed to the wall.

The external shape and texture of the sleeve, and in particular its handle, may be any shape that it is comfortable to hold by a human hand. The figures show a particular shape, but other shapes may be equally suited. For example, the material of the sleeve may be any solid material such as a hard rubber, a metal, wood, plastic, etc. The sleeve may be made of one or more parts. In general, any shape, material and construction of the sleeve can be used, provided the sleeve can guide the piston along its length axis to drive the nail into the substrate as described. The sleeve texture may be smooth, rough or patterned as shown, to improve the grip by a hand.

The piston is preferably made of a metal, e.g. aluminum, iron, steel, and stainless steel, which is little affected by the impact of a driver. However, as it would be clear to anyone skilled in the art, the piston may be made of other materials such as hard plastics and composite materials, which can withstand the impact of a driver without significant self-damage.

The concave surface of the piston has a shape and size suitable to accept and guide a variety of nail heads. Moreover, pistons with a variety of different concave surfaces (but a common external diameter that fits inside the sleeve to produce a smooth relative movement) may be interchangeably used with the same sleeve to drive in nail of various sizes. Furthermore, the concave surface may actually be a cylindrical hole concentrically bored into the piston as in the Hilti tool, operative to accept a headless nail of appropriate diameter, or a truncated pyramid.

All patents mentioned in this specification are herein incorporated in their entirety by reference into the specification, to the same extent as if each individual patent was specifically and individually indicated to be incorporated herein by reference. In addition, citation or identification of any reference in this application shall not be construed as an admission that such reference is available as prior art to the present invention.

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art.

Furthermore, the terms "include", "comprise," "have" and their conjugates, shall mean, when used in the disclosure and/or claims, "comprising but not necessarily limited to."

It is noted that some of the above described embodiments may describe the best mode contemplated by the inventors and therefore may comprise structure, acts or details of structures and acts that may not be essential to the invention and which are described as examples. Structure and acts described herein are replaceable by equivalents, which perform the same function, even if the structure or acts are different, as known in the art. Therefore, the scope of the invention is limited only by the elements and limitations as used in the claims.

What is claimed is:

1. A nail-guiding device that assists in the proper guiding of a nail with respect to a surface and with respect to a driver, comprising:

a. a body including abutment features for abutment against the surface and a sleeve defining a linear passage;

b. a flexible membrane deployed so as to at least partially overlap an end of said linear passage, said flexible membrane including an opening for engaging the shaft of a nail; and c. a piston slideably engaged in said linear passage and operative to transfer the impact of the driver to the nail in a drive-in operation, wherein said membrane is sufficiently flexible to allow insertion via said opening of the head of a nail having dimensions greater than dimensions of said opening, and wherein said membrane is deployed relative to said abutment features such that when said abutment features are brought into abutment with the surface, at least a portion of said flexible membrane adjacent to said opening is spaced away from the surface, thereby holding and guiding the nail throughout said drive-in operation.

2. The device of claim 1, wherein said piston includes a first end operatively associated with said linear passage first end, the piston first end including a concave surface suitable for centering a head of said nail.

3. The device of claim 1, wherein said membrane is fixedly attached to said body.

4. The device of claim 3, wherein said fixed attachment is effected by gluing.

5. The device of claim 3, wherein said fixed attachment is effected by injection molding.

6. The device of claim 1, wherein said flexible membrane is made of rubber.

7. The device of claim 1, wherein said opening is round.

8. The device of claim 1, wherein said body includes an accessory storage compartment.

9. The device of claim 1, wherein said body includes a level indicator.

10. A hand tool for assisting the driving of a nail into a surface at a drive-in location, comprising:

a. a guiding mechanism having abutment features for abutting the surface and a flexible membrane nail holding and guiding element, said flexible membrane nail holding and guiding element including an opening for engaging the shaft of a nail; and b. a driving element slideably engaged in said guiding mechanism and operative to drive the nail into the substrate at the drive-in location, wherein said membrane nail holding and guiding element is sufficiently flexible to allow insertion via said opening of the head of a nail having dimensions greater than dimensions of said opening, and wherein said membrane nail holding and guiding element is deployed relative to said abutment features such that, when said abutment features are brought into abutment with the surface, at least a portion of said flexible membrane nail holding and guiding element adjacent to said opening is spaced away from the surface, thereby holding and guiding the nail throughout said drive-in operation.

11. The hand tool of claim 10, wherein said membrane is fixedly attached to said guiding mechanism.

12. The hand tool of claim 10, wherein said membrane is made of rubber.

13. The hand tool of claim 10, wherein said opening is round.

14. The hand tool of claim 10, wherein said opening is slit.

15. A method for driving a nail into a surface comprising the steps of:

a. providing a body including abutment features for abutment against the surface and a sleeve defining a linear passage;

b. providing a flexible membrane deployed so as to at least partially overlap an end of said linear passage, said flexible membrane including an opening for engaging the shaft of a nail;

c. providing a piston slideably engaged in said linear passage and operative to transfer the impact of the driver to the nail in a drive-in operation;

d. inserting the head of a nail via said opening, the head of the nail having dimensions greater than dimensions of said opening and passing through said opening by flexing of said membrane;

e. deploying said abutment features in abutment with the surface while at least a portion of said flexible membrane adjacent to said opening remains spaced away from the surface, thereby holding and guiding the nail; and f. impacting said piston so that the nail is driven into the surface while being guided by said flexible membrane.

16. The method of claim 15, wherein said piston includes a concave end, and wherein said step of inserting the head of the nail includes engaging the head of the nail with said concave end.

17. The method of claim 15, wherein said flexible membrane is a fixedly attached to said body.

* * * * *